United States Patent [19]

Deutsch

[11] 4,103,581

[45] Aug. 1, 1978

[54] CONSTANT SPEED PORTAMENTO

[75] Inventor: Ralph Deutsch, Sherman Oaks, Calif.

[73] Assignee: Kawaii Musical Instrument Mfg. Co., Hamamatsu, Japan

[21] Appl. No.: 718,791

[22] Filed: Aug. 30, 1976

[51] Int. Cl.[2] ..... G10H 1/02

[52] U.S. Cl. ..... 84/1.24

[58] Field of Search ..... 84/1.01, 1.03, 1.17, 84/1.19, 1.22, 1.23, 1.24, 1.25, DIG. 26

[56] References Cited

U.S. PATENT DOCUMENTS

| | | | |
|---|---|---|---|
| 3,898,905 | 8/1975 | Schreier | 84/1.01 |
| 3,906,830 | 9/1975 | Mathias | 84/1.01 |
| 3,929,053 | 12/1975 | Deutsch | 84/1.24 |
| 3,952,623 | 4/1976 | Deutsch | 84/1.24 |
| 3,979,996 | 9/1976 | Tomisawa et al. | 84/1.25 |
| 4,016,792 | 4/1977 | Schrecongost | 84/1.01 |

*Primary Examiner*—Robert K. Schaefer
*Assistant Examiner*—Jit W. Miska
*Attorney, Agent, or Firm*—Christie, Parker & Hale

[57] ABSTRACT

A keyboard operated tone synthesizer with portamento effect in which each key controls the pitch of the generated tone through a table of frequency numbers, each key selecting a corresponding frequency control number from the table and converting this number to an analog voltage which is applied to a voltage controlled oscillator, the oscillator in turn controlling the pitch of the associated tone generated by the synthesizer. The portamento effect of having the pitch of one note slide smoothly into the pitch of the next note is achieved by subtracting the frequency number of a new note to be generated from the frequency number controlling the frequency of the note currently being generated. A fraction of the difference is stored in an increment register and added over and over to the frequency number of the current note at a controlled rate until the frequency control number equals the frequency control number of the new note. Thus the transition from one note to the other takes place in a fixed number of incremental steps, the transition time being independent of the difference in pitch between the two successive notes.

12 Claims, 1 Drawing Figure

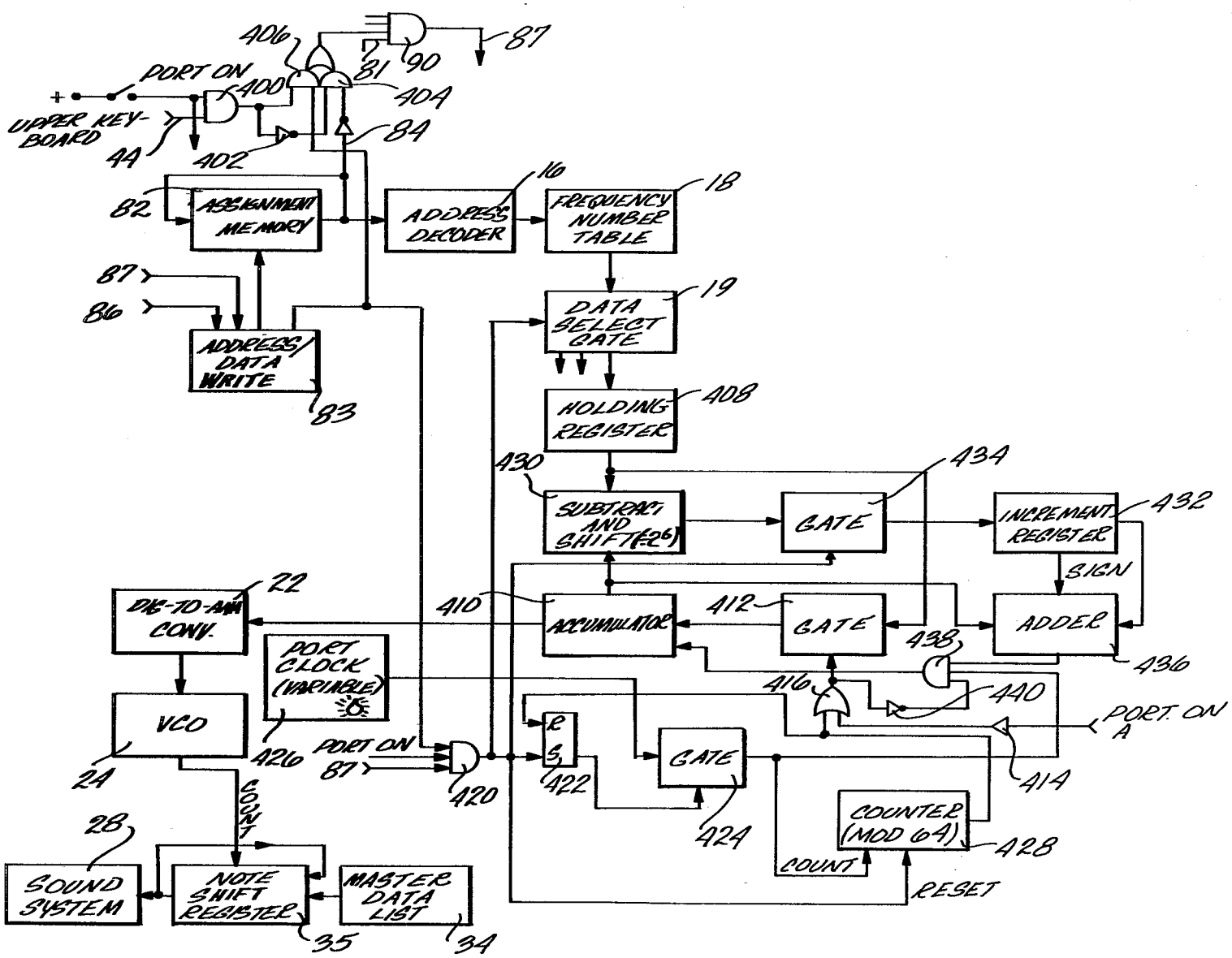
UPPER KEY-BOARD
PORT ON
ADDRESS DECODER
FREQUENCY NUMBER TABLE
DATA SELECT GATE
HOLDING REGISTER
SUBTRACT AND SHIFT (÷2)
ACCUMULATOR
GATE
GATE
INCREMENT REGISTER
ADDER
SIGN
PORT ON A
COUNTER (MOD 64)
COUNT
RESET
GATE
PORT ON
PORT CLOCK (VARIABLE)
MASTER DATA LIST
NOTE SHIFT REGISTER
SOUND SYSTEM
VCO
DIG-TO-ANA CONV.
ADDRESS DATA WRITE
ASSIGNMENT MEMORY

CONSTANT SPEED PORTAMENTO

FIELD OF THE INVENTION

This invention relates to musical instruments of the tone synthesizer type, and more particularly, is concerned with providing a portamento effect in a digitally controlled tone synthesizer.

BACKGROUND OF THE INVENTION

In my copending application Ser. No. 603,776, filed Aug. 11, 1975, and entitled "Polyphonic Tone Synthesizer", there is described a musical instrument in which musical notes are generated in response to operation of a conventional keyboard. The waveform of each note is controlled by data calculated and stored in a master data list, the data being converted by a digital-to-analog converter to an analog waveform. The fundamental frequency of the waveform is determined by a voltage-controlled oscillator, the input voltage in turn being determined by the addressing of a frequency control number from the frequency number table. The particular key on the keyboard determines the address of the frequency number in the table, in a manner more specifically described in copending application Ser. No. 634,533, filed Nov. 24, 1975, and entitled "Frequency Number Controlled Clocks".

The present invention is directed to an improvement in the musical instrument described in the above-identified copending applications by which a portamento effect can be produced. The portamento effect is characterized by the sliding of the pitch of each note in a smooth transition to the pitch of the next note as successive notes are played on the keyboard. The present invention provides a transition which takes place over a time interval which is independent of the frequency of the notes. The transition takes place in a fixed number of incremental steps of equal frequency change, the change in frequency in each incremental step being a fixed fraction of the total frequency change in going from one note to the next. The total transition time can be adjusted to provide a slow or fast transition. Playing a succession of notes in a time less than the normal transition time does not interrupt or break the smooth frequency transition since the transition sequence begins at the same frequency present when the last key in the sequence is activated, even though the frequency has not reached the value of the previously executed key in the sequence.

SUMMARY OF THE INVENTION

In brief, the present invention provides a portamento tone generator which includes an accumulator for storing a frequency number. The frequency number in the accumulator in turn is applied to a digital-to-analog converter, the voltage level of the output determining the frequency of a voltage-controlled oscillator. The output of the voltage-controlled oscillator fixes the fundamental frequency of the generated musical note. As each new note on the keyboard is operated, a new frequency number is read out of a frequency number table and subtracted from the previous frequency control number in the accumulator. The difference is divided by a constant value to form an incremental value which is a fraction of the difference between the two frequency numbers. This incremental value is then added or subtracted from the frequency number in the accumulator at repeated intervals to increment or decrement the number in the accumulator in steps until the value in the accumulator corresponds to the new frequency number. With each incremental change of the number in the accumulator, the frequency of the voltage-controlled oscillator shifts by a corresponding incremental amount from the frequency of the previous note until the number in the accumulator corresponds to the frequency number of the new note.

DESCRIPTION OF THE DRAWINGS

For a more complete understanding of the invention, reference should be made to the accompanying drawing, wherein the single figure is a schematic block diagram of the preferred embodiment of the present invention.

DETAILED DESCRIPTION

In copending application Ser. No. 603,776 entitled "Polyphonic Tone Synthesizer", there is described a musical tone generating system in which any one of a plurality of tone generators is assigned to a note when a key is actuated. As each key is actuated on the instrument, data identifying the note and the key assignment status is stored in a Read/Write assignment memory. A suitable circuit indicated at 14 in FIG. 1, for sensing the condition of the keys storing such information is described in U.S. Pat. No. 4,022,098, entitled "Keyboard Switch Detect and Assignor". Once a key is assigned to a note generator, the pitch of the note is determined by a voltage controlled oscillator in the assigned tone generator in response to the note information stored when the key is actuated. The manner of controlling the frequency of the oscillator for each tone generator is described in detail in the above-identified application Ser. No. 634,533, filed Nov. 24, 1975. The present invention, while not specifically limited to an instrument incorporating the features of the above-identified patent applications, is described herein in the preferred embodiment as a modification to such a system. Portions of the circuit described herein which are common to the circuits described in the above-identified copending applications are identified by the same reference numbers.

Referring to the drawing in detail, the numeral 82 refers to an assignment memory which stores a plurality of control words, one for each tone generator of the polyphonic system. It is assumed for the purposes of the present disclosure that one tone generator is permanently assigned to the portamento mode of operation and therefore one control word in the assignment memory 82 is always associated with the dedicated portamento tone generator. When operating in the portamento mode only the upper keyboard is used and only a single note at a time can be played. In other words, when operating in the portamento mode, the upper keyboard is restricted to monophonic operation. The keyboard and associated keyboard switch detect circuit may be modified to limit the keyboard to monophonic operation by a priority circuit (not shown) that allows only a single output signal when more than one key is operated at a time. Such a monophonic control is described, for example, in copending application Ser. No. 712,736, filed Aug. 9, 1976, entitled "An Automatic Digital Circuit for Generating Chords in a Digital Organ".

As described in the above-identified U.S. Pat. No. 4,022,098, whenever a key on the keyboard is operated, a signal is generated on a line 87 going to a Memory Address/Data Write control 83 which causes one of the control words in the assignment memory to be assigned to that key by turning on an assignment bit in the control word and loading the control word with the data identifying the note, the octave in which the note is located, and the keyboard in which the key is located. Once a control word is assigned to a key, it is used to address a frequency number in a table, which number in turn is used to control a voltage-controlled oscillator in an assigned tone generator, in the manner described in detail in the above-identified copending application Ser. No. 634,533. The signal on line 87 is derived from the output of an AND gate 90 which senses an input on line 81 indicating that a key has been operated and that the control word being addressed in the assignment memory 82 has the assignment bit turned off. The latter condition is present because the control word has not been assigned to any other key. The status of the assignment bit is sensed by an output line 84 from the assignment memory 82 which normally is applied directly to the input of the AND gate 90 through an inverter. However, when operating in the portamento mode, an AND gate 400 senses that the portamento mode is on, as indicated by a signal on an input line PORT, and that the upper keyboard is being scanned, as indicated by a signal on the input line 44 from the division counter 63, as described in detail in U.S. Pat. No. 4,022,098. The output of the AND circuit 400 is applied through an inverter 402 to the input of an AND gate 404 together with the output of the inverter in the line 84. Thus when the portamento is not present, the line 84 is coupled through the inverter to the AND gate 90 exactly in the manner described in the above-identified U.S. Pat. No. 4,022,098. However, when the portamento mode is on, an AND circuit 406 couples an output signal from the address circuit 83 to the input of the AND circuit 90, indicating that the control word assigned to the portamento tone generator is being addressed in the assignment memory. Line 87 causes the portamento control word in the assignment memory to be loaded with the note, octave, and keyboard information by means of the Memory Address/Data Write control 83 in the manner described in detail in U.S. Pat. No. 4,022,098. Thus whenever operating in the portamento mode, the specific control word dedicated to portamento tone generation is loaded with data identifying the particular key in the upper keyboard that is being depressed.

The control words in the assignment memory are read out of the assignment memory in sequence and applied to the input of an address decoder 16. The address decoder in response to each control word, addresses a frequency number in a table 18. This number controls the frequency of a voltage controlled oscillator in the assigned tone generator, in the manner described in detail in application Ser. No. 634,533. When the specific control word in the assignment memory 82 associated with the portamento mode is read out of the assignment memory 82, the associated frequency number in the table 18 is transferred by a data select gate 19 to a holding register 408. To this end, the output of an AND gate 420 is applied to the data select gate 19 to signal that the portamento control word is being addressed, thereby forcing the gate 19 to direct the frequency number to the holding register 408.

The holding register 408 is part of a tone generator which is always assigned to the upper keyboard whenever the instrument is operating in the portamento mode. This tone generator includes a digital-to-analog converter 22 which, in response to a frequency number from the table 18 modified by the portamento control in the manner hereinafter described, generates an analog voltage which controls the frequency of a voltage-controlled oscillator 24. The voltage-controlled oscillator in turn acts as a clock source for a Note Shift register 35 which stores tone data from a master data list source 34. The data from the Note Shift register 35 in turn is used to generate a musical tone by means of a sound system 28, the pitch of the tone being determined by the frequency of the voltage controlled oscillator 24, all in the manner described in detail in the above-identified copending application Ser. No. 603,776.

The frequency number which controls the digital-to-analog converter 22 is stored in an accumulator 410. When the tone generator is not operating in the portamento mode, the accumulator 410 may be loaded directly from the frequency number table 18 through the data select gate 19 and a gate 412. The gate 412 is normally open when the portamento mode is off, as sensed by applying the Port On signal through an inverter 414 and OR circuit 416 to the gate 412. This permits the tone generator to be assigned to any key on demand in the normal manner.

When operating in the portamento mode, the AND circuit 420, sensing that the control word assigned to portamento is being addressed by the address circuit 83 and that a key on the upper keyboard has been actuated, as indicated by a signal on the line 87, sets a control flip-flop 422, the output of which turns on a gate 424. The gate 424 transfers pulses from a portamento clock 426 to a counter 428. The counter 428 is, by way of example, a modulo 64 counter. The modulo 64 corresponds to the number of increments of frequency shift involved in the transition from one note to the next note when operating in the portamento mode. The clock rate of the portamento clock 426, by controlling the rate at which the counter 428 is counted up, determines the time interval required for the transition to take place. The frequency of the portamento clock may be made adjustable to permit the transition time to be made slow or fast. Whenever the counter 428 is counted up to its maximum count condition, it operates the gate 412 through an OR circuit 416, causing the frequency number in the holding register 408 to be transferred to the accumulator 410. At the same time, the output of the counter 428 resets the control flip-flop 422 thereby interrupting the operation of the counter 428. This condition remains until another key on the upper keyboard is operated and the control flip-flop 422 is again set.

To provide an incremental change in frequency during the transition from one note to another during the counting of the counter 428, the frequency number of the newly actuated key now in the holding register 408 is compared with the prior frequency number in accumulator 410 in a Subtract and Shift circuit 430. The circuit 430 generates the difference between the two numbers and in effect divides the difference by 64 by shifting the binary number in the accumulator to the right six places, thereby in effect dividing by 26. Thus the output from the Subtract and Shift circuit 430 corresponds to 1/64th of the difference between the frequency numbers in the holding register 408 and the accumulator 410. This incremental value is stored in an Increment register 432 by means of a gate 434. The gate 434 is turned on by the output of the AND circuit 420 at the time the new key is detected.

The contents of the Increment register 432 are added to the accumulator (or subtracted from the accumulator, depending on the sign) by an adder circuit 436. The output of the adder is coupled back to the accumulator 410 through an AND circuit 438 in response to the clock pulses from the portamento clock 426. The AND circuit 438 also senses that the gate 412 is Off, as indicated by the output of an inverter 440 connected to the output of the OR circuit 416.

In operation, through the circuit arrangement of FIG. 1, whenever the upper keyboard is operating in the portamento mode and a key has been operated on the upper keyboard, the frequency number for that key is stored in the accumulator 410. This frequency number fixes the pitch of the tone being generated by means of the digital-to-analog converter 22 and voltage controlled oscillator 24. Whenever another key is actuated on the upper keyboard, a frequency transition takes place by which the frequency number in the accumulator 410 is incremented or decremented in 64 equal steps to the frequency number of the new key. The transition rate is controlled by the frequency of the portamento clock 426 and by the number of incremental steps determined by the modulo of the counter 428. It should be noted that the counter 428 is reset whenever a new key is operated in the upper keyboard. Thus the transition count is restarted whenever a key is operated and the transition period starts with the current value in the accumulator 410. Thus even though a third key is actuated in the middle of a transition between the pitch of a first operated key to the pitch of a second operated key, the frequency excursion continues without interruption to the last note played. This permits operation with relatively long release times on the notes and with long portamento transition times. It will be noted that the contents of the accumulator 410 when the first portamento note is played may be any frequency number, including zero. The accumulator could be loaded initially to some preset value or cleared. The tone generator then goes through a transition from whatever state the accumulator is in initially. However, this does not materially affect the sound of the instrument. If desired, the accumulator could be loaded initially with the frequency number of the first key operated after the portamento mode is initiated, so that no transition results when the first note is played. All subsequent notes then start from the frequency of the prior note and slide up or down to the new frequency in the manner described.

What is claimed is:

1. In a keyboard operated tone synthesizer in which the pitch of each note generated by the synthesizer is determined by a frequency control number stored in a table, the number being selected by operation of the associated key and used to set the frequency of an oscillator which fixes the fundamental frequency of the generated tone, a portamento control comprising:

accumulator means for storing a frequency control number, means responsive to operation of any selected key on the keyboard for selecting a corresponding frequency control number from said table, means subtracting the selected number from said table from the number in said accumulator means, means responsive to the operation of the selected key and to the subtracting means for periodically changing the number in the accumulator means in increments corresponding to a predetermined fraction of the output of the subtracting means, means interrupting the means periodically changing the number in the accumulator when the number in the accumulator is incremented a predetermined number of times, and means responsive to the contents of the accumulator means for generating a musical tone having a fundamental frequency fixed by the value of the number stored in the accumulator means.

2. Apparatus of claim 1 wherein the means periodically changing the number in the accumulator includes a clock pulse source, and means synchronizing the incremental changing of the number in the accumulator with said clock source.

3. Apparatus of claim 2 wherein the clock source is variable in frequency for controlling the rate at which the contents of the accumulator is changed by said means for periodically changing the number of the accumulator.

4. Apparatus of claim 3 further including counter means, means responsive to operation of the selected key for coupling the clock source to the counter means, and means interrupting the clock source when the counter means counts a predetermined number of clock pulses.

5. Apparatus of claim 4 further including means for transferring a frequency control number directly from the table into the accumulator when the counter has reached its maximum count condition.

6. In a keyboard operated tone synthesizer in which the pitch of each note generated by the synthesizer is determined by a frequency control number stored in a table, each number being selectively read out by the table by operation of the associated key on the keyboard and used to set the frequency of an oscillator which fixes the fundamental frequency of the generated tone generated by the operation of the associated key, a portamento control comprising:

an accumulator storing a frequency number, a holding register, means for transferring a frequency number from the table to the holding register in response to operation of a key, oscillator means coupled to the accumulator for generating an audio signal having a frequency determined by the number stored in the accumulator, means coupled to the accumulator and the holding register for generating an output signal coded to indicate the difference in the numbers in the accumulator and holding register wherein the holding register receives a new frequency number from memory in response to a key being operated, and means responsive to said output signal for incrementing the number in the accumulator periodically by an amount that is a predetermined fraction of said difference to change the number in the accumulator in incremental steps.

7. The apparatus of claim 6 further including clock means including a counter for generating a predetermined number of clock pulses corresponding to the inverse of said predetermined fraction, means initiating said clock means in response to loading of a new number in the holding means, the means incrementing the number in the accumulator being responsive to said clock pulses for incrementing the contents of the accumulator with each clock pulse.

8. Apparatus of claim 7 further including means transferring the number of said holding register into said accumulator following the last of said predetermined number of clock pulses.

9. Apparatus of claim 7 wherein said clock means includes means for selectively varying the clock rate at which said pulses are generated.

10. In a tone synthesizer in which the pitch frequencies for a plurality of keys are stored as frequency numbers in a memory, a frequency number being read out of the memory and transferred to a tone generator when an associated key is actuated, the tone generator comprising:

storing means for storing a frequency number, means responsive to the actuating of a first key for subtracting the frequency number in said storing means from the frequency number read out of memory corresponding to the pitch of said key and dividing the difference by an integer constant greater than one to generate an incremental value, means including a clock pulse source for incrementing the number in said storing means with each clock pulse by said incremented value, means responsive to the number in said storing means for generating a tone having a pitch determined by the number in said storing means whereby the pitch of a generated tone changes as the number in said storing means is incremented, means responsive to actuation of a second key for activating said means for subtracting and dividing to generate a new incremental value, the number in the storing means when the second key is activated being incremented by said new incremental value, and means interrupting said incrementing means when the periodically incremented number in the storing means is substantially the same as the number of the key being actuated.

11. Apparatus of claim 10 wherein said means interrupting said incrementing means includes counting means, means resetting the counting means whenever a key is activated, and means connecting the counting means to said clock pulse source, and means interrupting said means periodically incrementing the number in the storing means after a predetermined number of clock intervals corresponding to said integer constant.

12. In a keyboard operated tone synthesizer in which the pitch of each note generated by the synthesizer is determined by a frequency control number stored in a table, the number being selected by operation of the associated key and used to set the frequency of an oscillator which fixes the fundamental frequency of the generated tone, apparatus comprising an accumulator storing a frequency number, means responsive to operation of any selected key on the keyboard for reading out a corresponding frequency control number from the table, means responsive to the operation of a key on the keyboard for calculating and storing an incremental value that is a predetermined fraction of the difference between the number stored in the accumulator at the time the key is operated and the frequency number selectively read out from the table, means including a clock source for periodically incrementing the number in the accumulator by said calculated incremental value, said calculating means recalculating said incremental value whenever a new key is actuated and a new frequency number selectively read out of the table, and means interrupting said periodic incrementing means when the number in the accumulator has been incremented a predetermined number of times following the operation of a key.

* * * * *